US006162025A

United States Patent [19]

Okawa

[11] Patent Number: 6,162,025

[45] Date of Patent: Dec. 19, 2000

[54] VARIABLE DISPLACEMENT SWASH PLATE TYPE COMPRESSOR

[75] Inventor: Hiroshi Okawa, Tochigi, Japan

[73] Assignee: Calsonic Kansei Corporation, Tokyo, Japan

[21] Appl. No.: 09/175,417

[22] Filed: Oct. 20, 1998

[30] Foreign Application Priority Data

Oct. 21, 1997 [JP] Japan ..... 9-288754

[51] Int. Cl.[7] ..... F04B 1/26

[52] U.S. Cl. ..... 417/222.2; 92/12.2; 74/839

[58] Field of Search ..... 92/12.2; 91/505, 91/506; 417/222.1, 222.2, 269; 74/839

[56] References Cited

U.S. PATENT DOCUMENTS

| | | | |
|---|---|---|---|
| 5,292,233 | 3/1994 | Takenaka et al. | 417/222.2 |
| 5,316,446 | 5/1994 | Kimura | 417/269 |
| 5,540,559 | 7/1996 | Kimura et al. | 417/222.2 |
| 5,706,716 | 1/1998 | Umemura | 92/165 |
| 5,749,712 | 5/1998 | Umemura | 417/269 |

FOREIGN PATENT DOCUMENTS

| | | |
|---|---|---|
| 5-195949 | 8/1993 | Japan . |
| 6-101640 | 4/1994 | Japan . |
| 7-103138 | 4/1995 | Japan . |
| 8-61231 | 3/1996 | Japan . |

OTHER PUBLICATIONS

Patent Abstracts of Japan, vol. 097, No. 011, Nov. 28, 1997 & JP 09 175159 A (Calsonic Corp), Jul. 8, 1997.

*Primary Examiner*—Edward K. Look
*Assistant Examiner*—Thomas E. Lazo
*Attorney, Agent, or Firm*—Foley & Lardner

[57] ABSTRACT

In a variable displacement swash plate type compressor, a drive shaft is installed in a case to rotate about its axis. A generally spherical sleeve is axially slidably disposed on the drive shaft, a journal is disposed on the sleeve, and a swash plate is tightly disposed on the journal. For achieving a reliable pivotal movement of the journal relative to the sleeve, the following measures are practically employed. First and second parallel flat surfaces are provided at diametrically opposed portions of the sleeve. Third and fourth parallel flat surfaces are formed on diametrically opposed portions of an inner wall of a generally cylindrical bore defined in the journal. The sleeve is disposed in the generally cylindrical bore of the journal in such a manner that the first and second parallel flat surfaces slidably abut against the third and fourth parallel flat surfaces respectively. Pins are used for connecting the sleeve and the journal to permit the pivotal movement of the journal relative to the sleeve at the slidably mated portions between the first and third flat surfaces and between the second and fourth flat surfaces.

8 Claims, 3 Drawing Sheets

VARIABLE DISPLACEMENT SWASH PLATE TYPE COMPRESSOR

BACKGROUND OF THE INVENTION

1. Field of the Invention

The present invention relates in general to compressors for use in an automotive air conditioning system or the like, and more particularly to compressors of a variable displacement swash plate type.

2. Description of the Prior Art

Japanese Patent First Provisional Publications 8-61231 and 6-101640 show compressors of a variable displacement swash plate type, which comprise a drive shaft, a sleeve axially movably disposed on the drive shaft, a journal swingably disposed on the sleeve, a swash plate held by the journal to rotate together with the drive shaft while assuming an inclined position relative to the drive shaft, a plurality of cylinders arranged at evenly spaced intervals about an axis of the drive shaft, and a plurality of pistons respectively received in the cylinders and reciprocatively driven by the swash plate. For achieving the swinging movement of the journal on the sleeve, the sleeve has a convex outer surface with which a concave inner surface of the journal is slidably engaged. That is, a so-called "convex-concave surface sliding structure" is provided between the sleeve and the journal. With this structure, a satisfied inclination of the swash plate relative to the drive shaft is achieved with a compact unit including the journal and the sleeve.

However, as is known, due to difficulty with which the convex and concave surfaces are machined, manufacturing of such convex-concave surface sliding structure requires a skilled and thus costly processing technique. In particular, the processing of the concave surface is quite difficult.

Furthermore, it tends to occur that the mutually engaging surfaces encounter a lack of lubrication oil. That is, when the compressor is used in the air conditioning system, the lubrication oil is dispersed in a refrigerant compressed by the compressor. However, due to the nature of the convex-concave surface sliding structure, the mutually engaging surfaces tend to fail to receive a sufficient amount of lubrication oil from the refrigerant.

SUMMARY OF THE INVENTION

It is therefore an object of the present invention to provide a variable displacement swash plate type compressor which is free of the above-mentioned drawback.

According to the present invention, there is provided a variable displacement swash plate type compressor which comprises a case; a drive shaft installed in the case to rotate about its axis; a generally spherical sleeve axially slidably disposed on the drive shaft; a journal disposed on the sleeve; a pivotal structure for permitting a pivotal movement of the journal relative to the sleeve; a swash plate tightly disposed on the journal to move therewith; and a drive plate secured to the drive shaft to rotate therewith, the drive plate engaging with the journal to rotate the journal together with the drive shaft while permitting the pivotal movement of the journal relative to the sleeve, wherein the pivotal structure comprises first and second parallel flat surfaces provided at diametrically opposed portions of the generally spherical sleeve; third and fourth parallel flat surfaces formed on diametrically opposed portions of an inner wall of a generally cylindrical bore defined in the journal, the sleeve being disposed in the generally cylindrical bore of the journal in such a manner that the first and second parallel flat surfaces are slidably mated with the third and fourth parallel flat surfaces respectively; and pins for connecting the sleeve and the journal to permit the pivotal movement of the journal relative to the sleeve at the slidably mated portions between the first and third flat surfaces and between the second and fourth flat surfaces.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Figure 1:
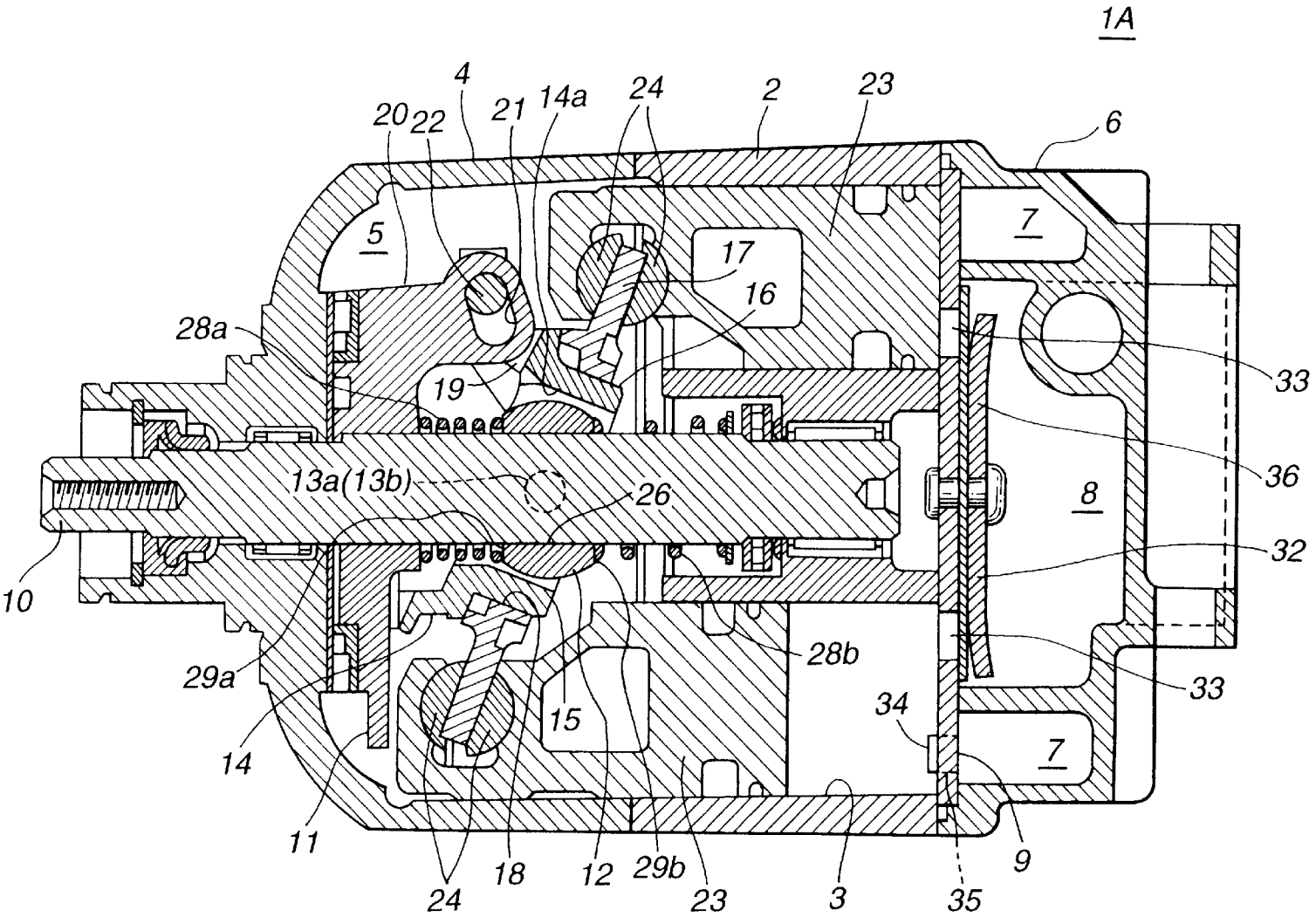
FIG. 1 is a sectional view of a variable displacement swash plate type compressor which is a first embodiment of the present invention.
Figure 2:
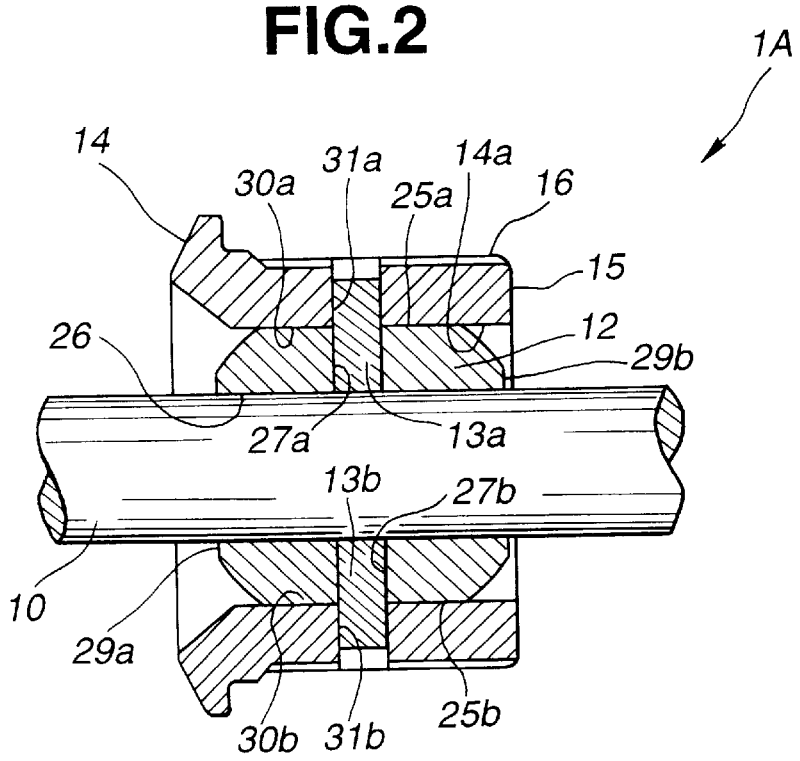
FIG. 2 is an enlarged sectional view of an essential portion of the first embodiment, showing a sleeve and a journal which are incorporated with a drive shaft.

Referring to FIGS. 1 and 2 of the drawings, there is shown a variable displacement swash plate type compressor 1A which is a first embodiment of the present invention.

As is shown in FIG. 1, the compressor 1A comprises a cylinder block 2 having a plurality of cylinders 3 circularly arranged therein, a front housing 4 coaxially connected to a front end of the cylinder block 2 to define therein a crank chamber 5, and a rear housing 6 connected to a rear end of the cylinder block 2 to define therein refrigerant intake and exhaust chambers 7 and 8. A valve plate 9 is intimately interposed between the cylinder block 2 and the rear housing 6, as shown.

In the crank chamber 5, there extends axially a drive shaft 10 to which a drive plate 11 is fixed to rotate therewith. Behind the drive plate 11, there is positioned a sleeve 12 which is axially movably disposed on the drive shaft 10. First and second biasing springs 28*a* and 28*b* are disposed on the drive shaft 11, between which the sleeve 12 is interposed and balanced. A journal 14 is pivotally connected to the sleeve 12 through aligned pins 13*a* and 13*b*. As will be described hereinafter, the journal 14 is formed with a generally cylindrical bore 14*a* for receiving the sleeve 12. A circular swash plate 17 is concentrically mounted on the journal 14 to move therewith. For this mounting, the swash plate 17 has its threaded cylindrical inner wall 18 engaged with a threaded cylindrical outer wall 16 of a boss portion 15 of the journal 14. That is, a so-called screw-nut connecting structure is provided between the swash plate 17 and the journal 14.

The journal 14 is formed with a forwardly projected arm 19 which is pivotally connected with a rearwardly projected arm 20 of the drive plate 11. For this pivotal connection, the arm 20 is formed with an elongate opening 21 with which a pin 22 possessed by the arm 19 is slidably engaged. Due to this pivotal connection, the pivotal movement of the swash plate 17 relative to the drive shaft 10 is restricted.

The cylinders 3 in the cylinder block 2 have respective pistons 23 slidably received therein. Each piston 23 has an exposed neck portion which slidably holds a peripheral portion of the swash plate 17 through a pair of shoes 24. That is, the shoes 24 are pivotally held by the neck portion while slidably putting therebetween the peripheral portion of the swash plate 17.

The inclination angle of the swash plate 17 is determined by a pressure in the crank chamber 5, which is controlled by a pressure control valve (not shown) in accordance with a pressure in the refrigerant intake chamber 7. The detail of the pressure control valve is shown in, for example, U.S. Pat. No. 5,749,712 granted to Yukio UMEMURA on May 12, 1998. That is, in accordance with the inclination angle of the swash plate 17, the stroke of each piston 23 is changed and thus the displacement of the compressor 1A is changed.

Denoted by numerals 32 are reed valves for opening and closing outlet openings 33 formed in the valve plate 9, denoted by numerals 34 are reed valves for opening and closing inlet openings 35 formed in the valve plate 9, and denoted by numeral 36 is a retainer for retaining open degree of the reed valves 32.

When, in operation, the drive shaft 10 is rotated by, for example, an engine of an associated motor vehicle, the drive plate 11 and the inclined swash plate 17 are rotated together about an axis of the drive shaft 10. Due to the rotation of the inclined swash plate 17, the piston 23 are forced to reciprocate in the associated cylinders 3 thereby to compress the refrigerant directed to the exhaust chamber 8. When the inclination angle of the swash plate 17 is changed due to the above-mentioned reason, the stroke of the pistons 23 is changed and thus the compression degree of the compressor 1A is varied.

The first embodiment has the following additional features which will be described with reference to FIGS. 1 and 2.

As is seen from FIG. 1, the sleeve 12 has a generally spherical shape and has both a larger diameter through bore 26 through which the drive shaft 10 passes and aligned holes 27*a* and 27*b* through which the pins 13*a* and 13*b* penetrate.

As is well seen from FIG. 2, the generally spherical sleeve 12 has at diametrically opposed portions thereof first and second parallel flat surfaces 25*a* and 25*b* respectively. Each surface 25*a* or 25*b* extends in parallel with an axis of the through bore 26. That is, the first and second parallel flat surfaces 25*a* and 25*b* are arranged at opposed portions with respect to an axis of the drive shaft 10. The aligned holes 27*a* and 27*b* for the pins 13*a* and 13*b* pass through centers of the first and second parallel flat surfaces 25*a* and 25*b*.

The generally spherical sleeve 12 is formed at front and rear portions with parallel flat surfaces 29*a* and 29*b* against which a rear end of the first biasing spring 28*a* and a front end of the second biasing spring 28*b* abut respectively. That is, each flat surface 29*a* or 29*b* serves as a spring seat.

As is seen from FIGS. 1 and 2, the journal 14 has in the boss portion 15 a generally cylindrical bore 14*a* which is somewhat larger than the size of the sleeve 12, so that the journal 14 can pivot relative to the sleeve 12 about an axis of the aligned pins 13*a* and 13*b*. Furthermore, the journal 14 has aligned holes 31*a* and 31*b* through which the pins 13*a* and 13*b* penetrate.

As is seen from FIG. 2, the generally cylindrical bore 14*a* of the journal 14 has at diametrically opposed portions thereof third and fourth parallel flat surfaces 30*a* and 30*b* which slidably contact the first and second flat surfaces 25*a* and 25*b* of the sleeve 12. The aligned holes 31*a* and 31*b* pass through centers of the third and fourth parallel flat surfaces 30*a* and 30*b*.

To mount the sleeve 12 and the journal 14 onto the drive shaft 10, the following steps may be taken.

The sleeve 12 is thrust into the generally cylindrical bore 14*a* of the journal 14 having the first and second parallel flat surfaces 25*a* and 25*b* of the sleeve 12 intimately mated with the third and fourth parallel flat surfaces 30*a* and 30*b* of the journal 14, and then relative positioning between the sleeve 12 and the journal 14 is so made that the aligned holes 27*a* and 27*b* of the sleeve 12 become aligned with the aligned holes 31*a* and 31*b* of the journal 14. Then, the pin 13*a* is thrust into the aligned holes 27*a* and 31*a*, and the other pin 13*b* is thrust into the other aligned holes 27*b* and 31*b* to constitute a unit which consists of the sleeve 12, the journal 14 and the two pins 13*a* and 13*b*. Then, the unit is disposed on the drive shaft 19 at the given position between the two biasing springs 28*a* and 28*b*, and then the swash plate 17 is turned onto the journal 14 of the unit. Upon this mounting, each pin 13*a* or 13*b* is restrained in the aligned holes 27*a* and 31*a* (or, 27*b* and 31*b*).

In the following, advantages possessed by the compressor 1A of the first embodiment of the present invention will be described.

First, a so-called "flat-flat surface sliding structure" is employed for the pivotal connection between the sleeve 12 and the journal 14. That is, the flat-flat surface sliding structure is made through the first and second flat surfaces 25*a* and 25*b* of the sleeve 12 and the third and fourth flat surfaces 30*a* and 30*b* of the journal 14, unlike in case of the above-mentioned conventional compressors which employ the "convex-concave surface sliding structure" for such pivotal connection. As is known, machining of a flat surface is quite easy as compared with that of the convex and concave surfaces, which can bring about a reduced cost of the compressor 1A of the first embodiment.

Second, due to the nature of the flat-flat surface sliding structure, the mutually engaging flat surfaces 25*a*, 30*a*, 25*b* and 30*b* are largely exposed to the crank chamber 5, which increases a chance to allow the surfaces 25*a*, 30*a*, 25*b* and 30*b* to receive a sufficient amount of lubrication oil from the refrigerant. Thus, lubrication by oil at such mutually engaging flat surfaces is sufficiently made.

Third, since the sleeve 12 is constructed to have a generally spherical shape, the journal 14 can largely pivot relative to the sleeve 12 without making an end thereof contact with the sleeve 12. This means that the compressor 1A of the first embodiment can be constructed compact in size like in the case of the above-mentioned conventional compressors.

Figure 3:
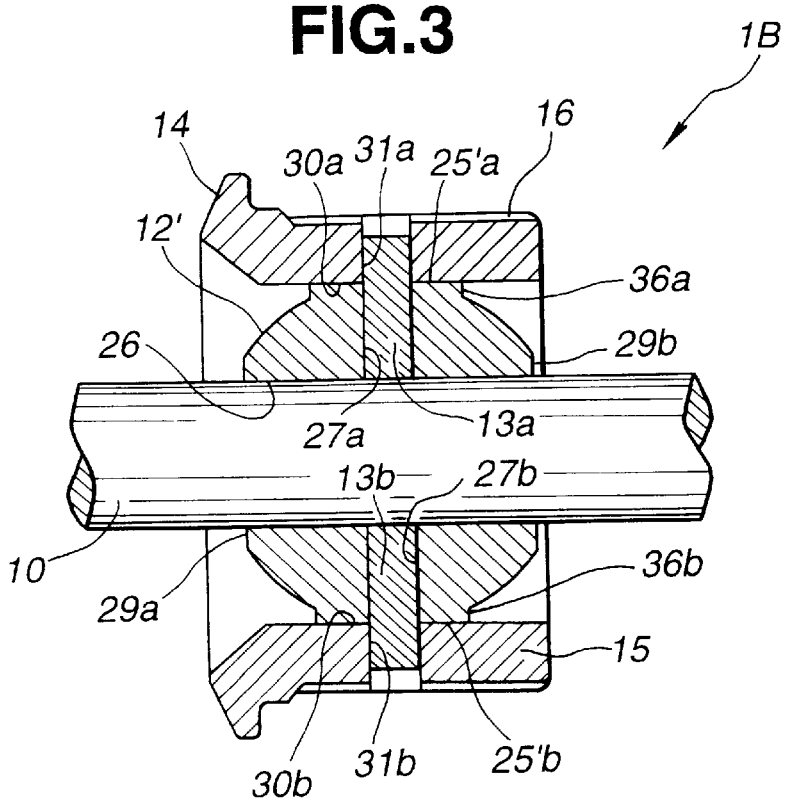
FIG. 3 is a view similar to FIG. 2, but showing a second embodiment.
Figure 4:
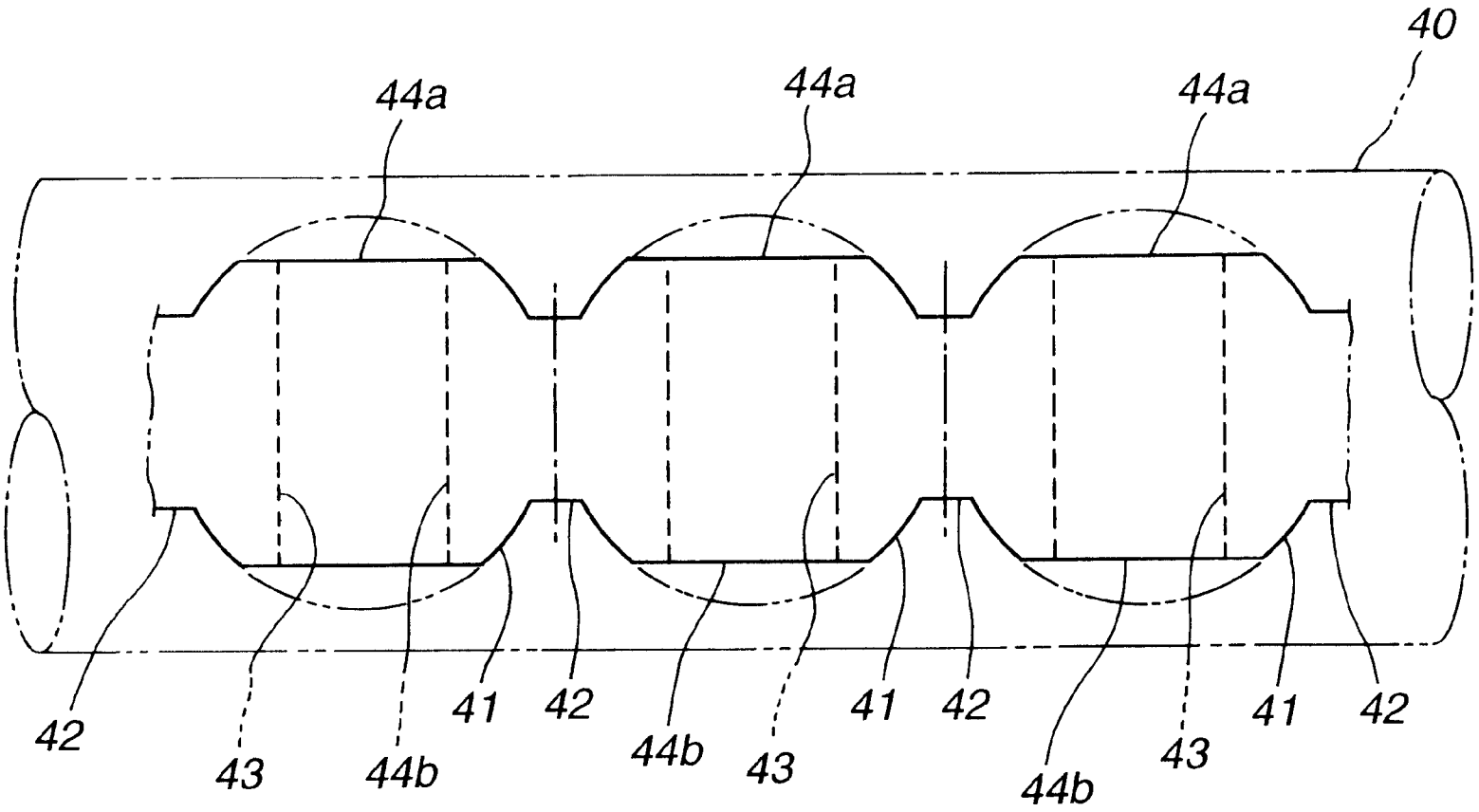
FIG. 4 is a view depicting the method of producing the sleeve employed in the second embodiment.

Referring to FIGS. 3 and 4, there is shown but partially a variable displacement swash plate type compressor 1B which is a second embodiment of the present invention.

The compressor 1B of this second embodiment is the same as the compressor 1A of the first embodiment except a sleeve 12'. Thus, only the sleeve 12' will be described in the following.

As is seen from FIG. 3, the generally spherical sleeve 12' has at diametrically opposed portions thereof projections 36*a* and 36*b*. Top portions of the projections 36*a* and 36*b* constitute flat surfaces 25'*a* and 25'*b* which are parallel with each other. Upon assembly, the flat surfaces 25'*a* and 25'*b* are in frictional contact with the third and fourth flat surfaces 30*a* and 30*b* of the journal 14, like in the case of the above-mentioned first embodiment.

In addition to the above-mentioned advantages possessed by the compressor 1A of the first embodiment, the following advantages are given to the compressor 1B of the second embodiment.

First, due to provision of the projections 36*a* and 36*b*, machining of the parallel flat surfaces 25'*a* and 25'*b* of the sleeve 12 is easily carried out. More specifically, the parallelism for the flat surfaces 25'*a* and 25'*b* is more easily achieved than that for the first and second flat surfaces 25*a* and 25*b* of the first embodiment.

Second, due to the shape of the sleeve 12' having the projections 36*a* and 36*b*, mass production of the sleeve 12' is easily made. That is, for the mass production, a round bar 40 is prepared, as is seen from FIG. 4. The round bar 40 is machined to produce a series of shaped structure including a plurality of spherical portions 41 connected through narrowed portions 42. The shaped structure is then machined to produce a through bore 43 in each spherical portion 41 and parallel flat surfaces 44*a* and 44*b* at front and rear ends of the through bore 43. Then, by using a cutter applied to the middle of each narrowed portion 42, the shaped structure is cut into pieces, each including one spherical portion 41 having two half-cut narrowed portions 42 at diametrically opposed portions thereof. Finishing process is applied to each piece to produce the sleeve 12'. It is to be noted that the through bore 43 corresponds to the through bore 26 of the sleeve 12' and the parallel flat surfaces 44*a* and 44*b* correspond to the front and rear parallel flat surfaces 29*a* and 29*b* of the sleeve 12'.

It is to be understood that, although the invention has been described with specific reference to particular embodiments thereof, it is not to be so limited since changes and alternations therein may be made within the full intended scope of this invention as defined by the appended claims.

What is claimed is:

1. A variable displacement swash plate type compressor comprising:

a case;

a drive shaft installed in said case to rotate about its axis;

a sleeve axially slidably disposed on said drive shaft, said sleeve being generally spherical in shape;

a journal disposed on said sleeve;

a pivotal structure for permitting a pivotal movement of said journal relative to said sleeve;

a swash plate disposed on said journal to move therewith; and a drive plate secured to said drive shaft to rotate therewith, said drive plate engaging with said journal to rotate said journal together with said drive shaft while permitting the pivotal movement of said journal relative to said sleeve, wherein said pivotal structure comprises:

first and second parallel flat surfaces provided at diametrically opposed outer surface portions of said generally spherical sleeve;

third and fourth parallel flat surfaces formed on diametrically opposed portions of an inner wall of a generally cylindrical bore defined in said journal, said sleeve being disposed in the generally cylindrical bore of said journal in such a manner that said first and second parallel flat surfaces are slidable mated with the third and fourth parallel flat surfaces respectively; and two aligned pins for connecting said sleeve and said journal to permit the pivotal movement of said journal relative to said sleeve at the slidably mated portions.

2. A variable displacement swash plate type compressor as claimed in claim 1, in which said first and second parallel flat surfaces of said sleeve are arranged at opposed portions with respect to an axis of said drive shaft.

3. A variable displacement swash plate type compressor as claimed in claim 2, in which one of said pins passes through centers of said first and third flat surfaces, and the other of said pins passes through centers of said second and fourth flat surfaces.

4. A variable displacement swash plate type compressor as claimed in claim 3, in which each of said pins is received in aligned holes respectively formed in said sleeve and said journal.

5. A variable displacement swash plate type compressor as claimed in claim 1, in which said first and second parallel flat surfaces are respectively formed on top portions of projections which are raised from the diametrically opposed portions of said sleeve.

6. A variable displacement swash plate type compressor as claimed in claim 1, further comprising:

a plurality of cylinders arranged in said case at evenly spaced intervals about an axis of said drive shaft;

a plurality of pistons respectively received in said cylinders;

converting means for converting the rotation of said swash plate to reciprocating movement of the pistons in the respective cylinders;

a first biasing spring disposed on said drive shaft to bias said sleeve toward said cylinders; and a second biasing spring disposed on said drive shaft to bias said sleeve toward said drive plate;

an intake chamber communicated with interior of each of said cylinders; and an exhaust chamber communicated with interior of each of said cylinders through reed valves.

7. A variable displacement swash plate type compressor as claimed in claim 6, in which said converting means comprises:

an exposed neck portion possessed by each of said pistons; and a pair of shoes pivotally held by said neck portion, said shoes slidably putting therebetween a peripheral portion of said swash plate.

8. A variable displacement swash plate type compressor as claimed in claim 7, in which said swash plate is detachably disposed on said journal through a screw-nut connecting structure.

* * * * *